US008012273B2

(12) United States Patent
Woodfield et al.

(10) Patent No.: US 8,012,273 B2
(45) Date of Patent: *Sep. 6, 2011

(54) PRODUCING METALLIC ARTICLES BY REDUCTION OF NONMETALLIC PRECURSOR COMPOUNDS AND MELTING

(75) Inventors: Andrew P. Woodfield, Cincinnati, OH (US); Clifford E. Shamblen, Blue Ash, OH (US); Eric A. Ott, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/824,666

(22) Filed: Jun. 28, 2010

(65) Prior Publication Data

US 2010/0258260 A1 Oct. 14, 2010

Related U.S. Application Data

(63) Continuation of application No. 11/059,715, filed on Feb. 16, 2005, now Pat. No. 7,766,992, which is a continuation of application No. 10/206,608, filed on Jul. 25, 2002, now Pat. No. 6,884,279.

(51) Int. Cl.
*B22F 9/18* (2006.01)

(52) U.S. Cl. ..... 148/513; 75/351; 75/367; 75/368; 75/369

(58) Field of Classification Search ..... 75/351, 75/369

See application file for complete search history.

(56) References Cited

U.S. PATENT DOCUMENTS

| | | | |
|---|---|---|---|
| 3,128,513 | A | 4/1964 | Charlton et al. |
| 3,773,101 | A | 11/1973 | Getselev |
| 4,016,052 | A | 4/1977 | Tokumoto et al. |
| 4,063,942 | A | 12/1977 | Lundgren |
| 4,113,582 | A | 9/1978 | Tokumoto et al. |
| 4,356,029 | A | 10/1982 | Down et al. |
| 4,622,079 | A | 11/1986 | Chang et al. |
| 4,678,506 | A | 7/1987 | Bania |
| 4,728,364 | A | 3/1988 | Bania |
| 4,731,111 | A | 3/1988 | Kopatz et al. |
| 4,818,562 | A | 4/1989 | Arcella et al. |

(Continued)

FOREIGN PATENT DOCUMENTS

DE 1129710 5/1962

(Continued)

OTHER PUBLICATIONS

Slides of Presentation: The Armstrong Process, presented by International Titanium Powder, LLC, 16 pages, 2002.

(Continued)

*Primary Examiner* — George Wyszomierski
(74) *Attorney, Agent, or Firm* — McNees Wallace & Nurick LLC

(57) ABSTRACT

A metallic article is produced by furnishing one or more nonmetallic precursor compound comprising the metallic constituent element(s), and chemically reducing the nonmetallic precursor compound(s) to produce an initial metallic particle, preferably having a size of no greater than about 0.070 inch, without melting the initial metallic particle. The initial metallic particle is thereafter melted and solidified to produce the metallic article. By this approach, the incidence of chemical defects in the metal article is minimized. The melted-and-solidified metal may be used in the as-cast form, or it may be converted to billet and further worked to the final form.

20 Claims, 2 Drawing Sheets

U.S. PATENT DOCUMENTS

| | | | | |
|---|---|---|---|---|
| 4,851,188 | A | 7/1989 | Schaefer et al. | |
| 5,204,057 | A | 4/1993 | Ishigami et al. | |
| 5,312,584 | A | 5/1994 | Frasier et al. | |
| 5,322,666 | A | 6/1994 | Watwe | |
| 5,460,642 | A | 10/1995 | Leland | |
| 5,779,761 | A | 7/1998 | Armstrong et al. | |
| 5,877,437 | A | 3/1999 | Oltrogge | |
| 5,930,580 | A | 7/1999 | Everett | |
| 5,958,106 | A | 9/1999 | Armstrong et al. | |
| 6,019,812 | A | 2/2000 | Volas et al. | |
| 6,540,811 | B2 | 4/2003 | Hosoe et al. | |
| 6,884,279 | B2 | 4/2005 | Woodfield et al. | |
| 7,604,680 | B2 * | 10/2009 | Shamblen et al. | 75/414 |
| 7,727,462 | B2 * | 6/2010 | Ott et al. | 419/66 |
| 7,766,992 | B2 * | 8/2010 | Woodfield et al. | 75/331 |
| 2003/0047463 | A1 | 3/2003 | Ward-Close et al. | |

FOREIGN PATENT DOCUMENTS

| | | | |
|---|---|---|---|
| JP | 59004947 | A | 1/1984 |
| JP | 62097747 | A | 5/1987 |
| JP | 2001212650 | A | 8/2001 |
| WO | 9964838 | A1 | 12/1999 |

OTHER PUBLICATIONS

ASM Materials Engineering Dictionary, ASM International, Dec. 1992, pp. 62 and 226.

ASM Handbook, vol. 7, Power Metallurgy, (c) 1984, ASM International, pp. 164-168.

* cited by examiner

FIG. 1
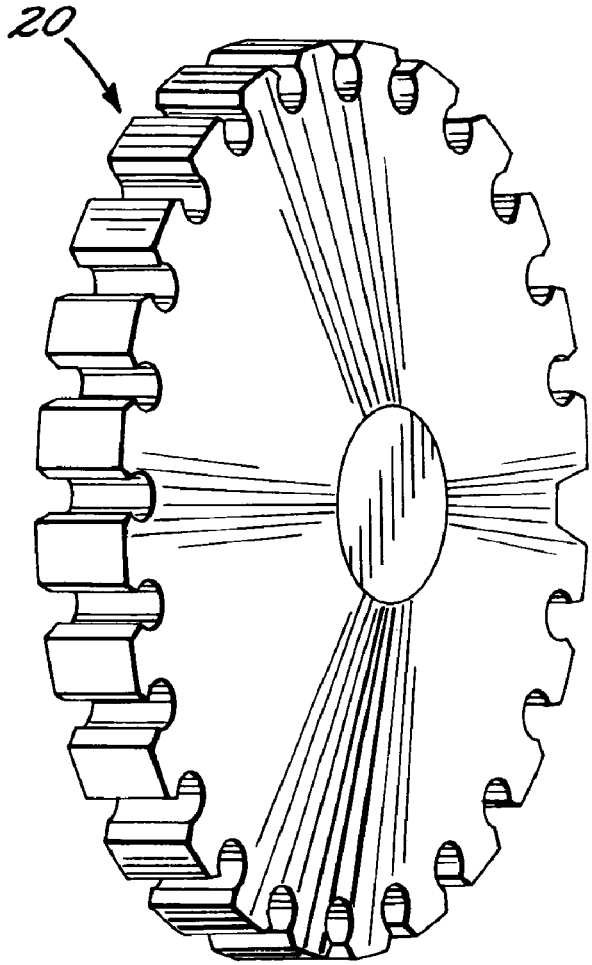
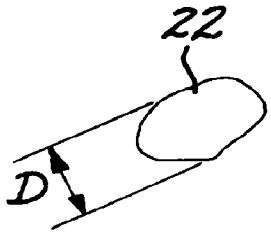
FIG. 3
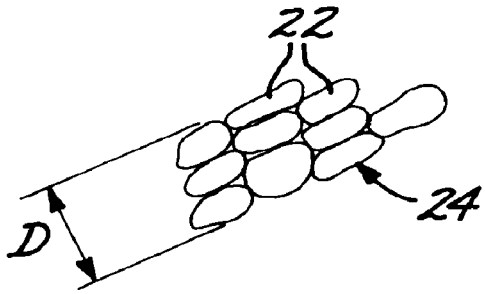
FIG. 4

PRODUCING METALLIC ARTICLES BY REDUCTION OF NONMETALLIC PRECURSOR COMPOUNDS AND MELTING

This invention relates to the production of a metallic article to minimize the presence of melt-related chemical defects and, more particularly, to the manufacture of titanium-alloy articles such as aircraft gas turbine components.

BACKGROUND OF THE INVENTION

Metallic articles are fabricated by any of a number of techniques, as may be appropriate for the nature of the metal and the article. In one common approach, metal-containing ores are refined to produce a metal. The metal may be further refined as necessary to remove or reduce the amounts of undesirable minor elements. The composition of the refined metal may also be modified by the addition of desirable alloying elements. These refining and alloying steps may be performed during the initial melting process or after solidification and remelting. After a metal of the desired composition is produced, it may be used in the as-cast form for some alloy compositions (i.e., cast alloys), or further worked to form the metal to the desired shape for other alloy compositions (i.e., wrought alloys). In either case, further processing such as heat treating, machining, surface coating, and the like may be employed.

One of the most demanding applications of materials in aircraft gas turbine engines is the disks (sometimes termed "rotors") upon which the turbine blades or compressor blades are supported. The disks rotate at many thousands of revolutions per minute, in an elevated-temperature environment, when the gas turbine is operating. They must exhibit the required mechanical properties under these operating conditions.

Certain ones of the gas turbine engine components such as some of the disks are fabricated from titanium alloys. The disks are typically manufactured by furnishing the metallic constituents of the selected titanium alloy, melting the constituents, and casting an ingot of the titanium alloy. The cast ingot is then converted into a billet. The billet is further mechanically worked, typically by forging. The worked billet is thereafter upset forged, and then machined to produce the titanium-alloy component.

Small mechanical or chemical defects in the final disk may cause the disk to fail prematurely in service. Mechanical defects include, for example, cracks and voids. Chemical defects include, for example, hard alpha defects (sometimes termed low-density inclusions) and high-density inclusions. Hard alpha defects, discussed for example in U.S. Pat. Nos. 4,622,079 and 6,019,812, whose disclosures are incorporated by reference, are particularly troublesome in premium-quality alpha-beta and beta titanium alloys used in demanding gas turbine engine applications, as well as other demanding applications such as aircraft structures. Chemical defects may cause cracks to form prematurely in engine service. A failure resulting from these defects may be catastrophic to the gas turbine engine and possibly to the aircraft. Consequently, it is necessary to fabricate the gas turbine engine disk with great care to minimize and desirably eliminate the presence of such defects, and to produce the disk in a manner that facilitates its ultrasonic inspection to detect such defects if they are present. The manufacturing process must also produce a microstructure in the final article that exhibits the desired combination of mechanical properties and physical properties required in the disk.

It has been possible, using existing melting, casting, and conversion practice, to reduce the presence and size of chemical defects in installed disks to reasonably low levels. However, there is always a desire and need for a manufacturing process to produce the disks and other components with a further reduction in the incidence of such chemical defects, thereby improving the operating margins of safety. The present invention fulfills this need for an improved process, and further provides related advantages.

BRIEF SUMMARY OF THE INVENTION

The present invention provides a method for producing a metallic article with reduced incidence of unacceptably large chemical defects. The reduction of the defects also allows economic improvements in the fabrication and operation of the gas turbine engine. The approach is particularly suitable for fabricating titanium-alloy articles such as gas turbine engine components, with fan and compressor disks being examples, by preparation of an initial metallic material, ingot casting, conversion of the ingot to a billet, mechanical working, machining, and ultrasonically inspecting the billet. The resulting metallic article has a desirable microstructure and mechanical properties, as well as a low-incidence of unacceptably large chemical defects that, where present, may lead to premature failure of the article in service.

There is provided a method for producing a metallic article comprising metallic constituent elements and of a composition otherwise susceptible to the formation of hard alpha phase, such as alpha-beta and beta titanium alloys. The method comprises the steps of furnishing a nonmetallic precursor compound comprising the metallic constituent element, chemically reducing the nonmetallic precursor compound to produce an initial metallic particle, without melting the initial metallic particle, and melting and solidifying the initial metallic particle to produce the metallic article. There is no mechanical comminution of the initial metallic particle. The step of furnishing the nonmetallic precursor compound may include furnishing two or more nonmetallic precursor compounds supplying different metallic elements of the alloy. Optionally, there by be an addition of a metallic alloying element to the material of the initial metallic particle during the melting step, or there may be no such addition during the melting step.

In another situation where the metallic article is a metallic alloy, the nonmetallic precursor compound may be furnished as a mixture of at least two different nonmetallic precursor compounds together comprising the constituents of the alloy. In an application of most interest, the nonmetallic precursor compound comprises titanium, so that the nonmetallic precursor compounds include titanium and at least one other metallic element.

The nonmetallic precursor compound may be furnished in a finely divided solid form, a liquid form, or a gaseous form. The chemical reduction may be accomplished by any operable technique, with examples being solid-phase reduction, fused salt electrolysis, plasma quench, or vapor-phase reduction.

In an approach of particular interest, the nonmetallic precursor compound in a gaseous form is chemically reduced by contact with a liquid alkali metal and/or a liquid alkaline earth metal. In such an approach, a nonmetallic modifying element such as oxygen or nitrogen may be mixed into the nonmetallic precursor compound to produce a desired level in the final metallic material. Such a chemical reduction is accomplished quite rapidly, preferably in a time of less than about 10 seconds, minimizing the time in which chemical defects such as hard alpha phase or high-melting point inclusions may form.

The step of melting and solidifying is used to form a cast article or ingot of the desired metallic composition. In the case of the cast ingot, the cast ingot may thereafter be converted to a billet by thermomechanical working. The billet is further mechanically worked, and finally machined to make an article such as a gas turbine engine disk. The workpiece is typically ultrasonically inspected as billet, and as a machined article.

One feature of the present approach is the preparation of the initial metallic particle without melting the initial metallic particle, and preferably with a relatively small size of no greater than about 0.5 inch, more preferably no greater than about 0.25 inch, more preferably no greater than about 0.070 inch, more preferably no greater than about 0.040 inch, and most preferably in the size range of from about 0.020 inch to about 0.040 inch. Desirably, the size is not smaller than about 0.001 inch. Because of the small maximum size in the preferred embodiment, the maximum size of chemical defects in the initial metallic particles is also small. As a result, the subsequent melting is able to dissolve the chemical defects so that they are removed and not present in the cast material. The subsequently produced metallic article therefore has a reduced incidence of chemical defects, and a reduced incidence of chemical defects of an unacceptably large size. The reduction in chemical defects leads to a more reliable final metallic article that is less subject to premature failure due to such defects. This attribute is particularly important for fracture-critical articles such as gas turbine disks.

The present approach requires fewer processing steps and thence fewer intermediate handling steps of the metallic material as compared with prior approaches. One of the primary sources of the introduction of chemical contamination, possibly leading to chemical defects, is the handling and contamination of the metallic material between processing steps such as multiple meltings of the metal. By reducing the number of processing steps, the amount of intermediate handling and thence opportunity for contamination, is reduced. Another potential source of contamination is comminution of the material, such as by crushing or shearing, when the material is presented in the form of large pieces such as sponge material or overly large particles, to produce smaller particles that are used in the melting step. The present approach avoids such comminution in its preferred embodiments, thereby reducing the incidence of contamination leading to chemical defects.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 1 is a perspective view of a metallic article prepared by the present approach;

FIG. 3 is an elevational view of an initial nonagglomerated metallic particle; and FIG. 4 is an elevational view of a group of initial agglomerated metallic particles.

DETAILED DESCRIPTION OF THE INVENTION

Figure 2:
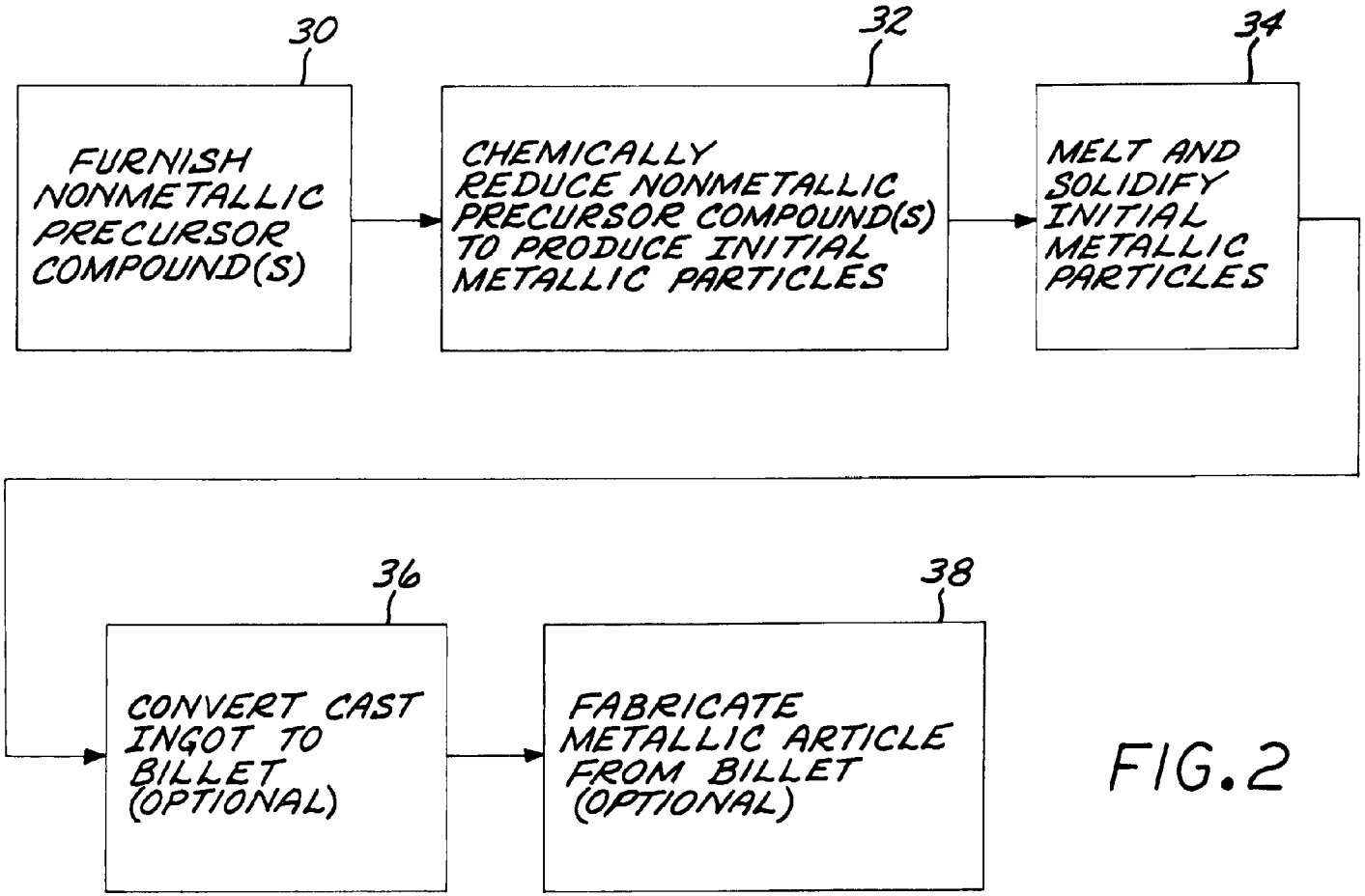
FIG. 2 is a block flow diagram of an approach for practicing the invention.

The present approach may be used to produce a wide variety of final articles 20. FIG. 1 illustrates one such article 20 of particular interest, an alpha-beta or beta titanium alloy gas turbine engine disk 20. The present approach is not limited to the production of such an article as depicted in FIG. 1, however. Some other examples of gas turbine engine components that may be produced with the present approach are spools, blisks, shafts, blades, vanes, cases, rings, and castings, as well as structural components for applications other than gas turbine engines such as airframe cast and wrought parts. Metallic alloys such as alpha-beta, near-alpha, and beta titanium alloys are potentially subject to the formation of hard alpha defects. The present approach reduces the incidence of such defects.

FIG. 2 illustrates a preferred approach for preparing an article of a base metal and one or more alloying elements. The method comprises providing one or more chemically reducible nonmetallic precursor compounds, step 30. "Nonmetallic precursor compounds" are nonmetallic compounds of the metals that eventually constitute the metallic article 20. Any operable nonmetallic precursor compounds may be used. Reducible oxides of the metals are the preferred nonmetallic precursor compounds in solid-phase reduction, but other types of nonmetallic compounds such as sulfides, carbides, halides, and nitrides are also operable. Reducible halides of the metals are the preferred nonmetallic precursor compounds in vapor-phase reduction.

A single nonmetallic precursor compound may supply a single metallic element. More commonly, the final metallic material is an alloy of two or more metallic elements, including a base metal and at least one metallic alloying element. The base metal is a metal that is present in a greater percentage by weight than any other element in the alloy. The base-metal precursor compound is present in an amount such that, after the chemical reduction to be described subsequently, there is more of the base metal present in the metallic alloy than any other element. In the preferred case, the base metal is titanium, and the precursor compound that supplies the titanium is titanium oxide, $TiO_2$ (for solid-phase reduction) or titanium tetrachloride (for vapor-phase reduction). The alloying element may be any element that is available in the chemically reducible form of a suitable precursor compound. A few illustrative examples are iron, chromium, tungsten, molybdenum, aluminum, niobium, silicon, tin, zirconium, manganese, and vanadium.

In the case of the preparation of metallic alloys, the nonmetallic precursor compounds are selected to provide the necessary metals in the final metallic article, and are mixed together in the proper proportions to yield the necessary proportions of these metals in the metallic article. For example, if the final article were to have particular proportions of titanium, aluminum, and vanadium in the ratio of 90:6:4 by weight, the nonmetallic precursor compounds are preferably titanium oxide, aluminum oxide, and vanadium oxide for solid-phase reduction, or titanium tetrachloride, aluminum chloride, and vanadium chloride for vapor-phase reduction. Nonmetallic precursor compounds that serve as a source of more than one of the metals in the final metallic article may also be used. These precursor compounds are furnished and mixed together in the correct proportions such that the ratio of titanium:aluminum:vanadium in the mixture of precursor compounds is that required to form the metallic alloy in the final article (90:6:4 by weight in the example). In this example, the final metallic article is a titanium-base alloy, which has more titanium by weight than any other element.

The single nonmetallic precursor compound or the mixture of nonmetallic precursor compounds in the case of an alloy are chemically reduced to produce initial metallic particles, without melting the initial metallic particles, step 32. As used herein, "without melting", "no melting", and related concepts mean that the material is not macroscopically or grossly melted for an extended period of time, so that it liquefies and loses its shape. There may be, for example, some minor amount of localized as low-melting-point elements melt and are diffusionally alloyed with the higher-melting-point elements that do not melt, or very brief melting for less than about 10 seconds. Even in such cases, the gross shape of the material remains unchanged.

In a preferred reduction approach, termed vapor-phase reduction because the nonmetallic precursor compounds are furnished as vapors or gaseous phase, the chemical reduction may be performed by reducing mixtures of halides of the base metal and the alloying elements using a liquid alkali metal or a liquid alkaline earth metal. For example, titanium tetrachloride and the halides of the alloying elements are provided as gases. A mixture of these gases in appropriate amounts is contacted to molten sodium, so that the metallic halides are reduced to the metallic form. The metallic alloy is separated from the sodium. This reduction is performed at temperatures below the melting point of the metallic alloy. The approach is described more fully in U.S. Pat. Nos. 5,779,761 and 5,958,106, whose disclosures are incorporated by reference.

Vapor-phase reduction in step 32 is preferred because of the short reaction times between the gaseous nonmetallic precursor compound(s) and the liquid alkali metal or the liquid alkaline earth metal. This short reaction time, which is desirably less than about 10 seconds, does not permit the creation of large chemical defects in the resulting reduced metal.

Reduction at lower temperatures rather than higher temperatures is preferred. Desirably, the reduction is performed at temperatures of 600° C. or lower, and preferably 500° C. or lower. By comparison, prior approaches for preparing titanium—and other metallic alloys often reach temperatures of 900° C. or greater. The lower-temperature reduction is more controllable, and also is less subject to the introduction of contamination into the metallic alloy, which contamination in turn may lead to chemical defects. Additionally, the lower temperatures reduce the incidence of sintering together of the particles during the reduction step.

In this vapor-phase reduction approach, a nonmetallic modifying element or compound presented in a gaseous form may be mixed into the gaseous nonmetallic precursor compound prior to its reaction with the liquid alkali metal or the liquid alkaline earth metal. In one example, oxygen or nitrogen may be mixed with the gaseous nonmetallic precursor compound(s) to increase the level of oxygen or nitrogen, respectively, in the initial metallic particle. It is sometimes desirable, for example, that the oxygen content of the initial metallic particle and the final metallic article be about 1200-2000 parts per million by weight to strengthen the final metallic article. Rather than adding the oxygen in the form of solid titanium dioxide powder, as is sometimes practiced for titanium-base alloys produced by conventional melting techniques, the oxygen is added in a gaseous form that facilitates mixing and minimizes the likelihood of the formation of hard alpha phase in the final article. When the oxygen is added in the form of titanium dioxide powder in conventional melting practice, agglomerations of the powder may not dissolve fully, leaving fine particles in the final metallic article that constitute chemical defects. The present approach avoids that possibility.

In another reduction approach, termed solid-phase reduction because the nonmetallic precursor compounds are furnished as solids, the chemical reduction may be performed by fused salt electrolysis. Fused salt electrolysis is a known technique that is described, for example, in published patent application WO 99/64638, whose disclosure is incorporated by reference in its entirety. Briefly, in fused salt electrolysis the mixture of nonmetallic precursor compounds, furnished in a finely divided solid form, is immersed in an electrolysis cell in a fused salt electrolyte such as a chloride salt at a temperature below the melting temperatures of the metals that form the nonmetallic precursor compounds. The mixture of nonmetallic precursor compounds is made the cathode of the electrolysis cell, with an inert anode. The elements combined with the metals in the nonmetallic precursor compounds, such as oxygen in the preferred case of oxide nonmetallic precursor compounds, are partially or completely removed from the mixture by chemical reduction (i.e., the reverse of chemical oxidation). The reaction is performed at an elevated temperature to accelerate the diffusion of the oxygen or other gas away from the cathode. The cathodic potential is controlled to ensure that the reduction of the nonmetallic precursor compounds will occur, rather than other possible chemical reactions such as the decomposition of the molten salt. The electrolyte is a salt, preferably a salt that is more stable than the equivalent salt of the metals being refined and ideally very stable to remove the oxygen or other gas to a desired low level. The chlorides and mixtures of chlorides of barium, calcium, cesium, lithium, strontium, and yttrium are preferred. The chemical reduction is preferably, but not necessarily, carried to completion, so that the nonmetallic precursor compounds are completely reduced. Not carrying the process to completion is a method to control the oxygen content of the metal produced.

In another reduction approach, termed "rapid plasma quench" reduction, the precursor compound such as titanium chloride is dissociated in a plasma arc at a temperature of over 4500° C. The precursor compound is rapidly heated, dissociated, and cooled. The result is fine metallic particles. Any melting of the metallic particles is very brief, on the order of 10 seconds or less, and is within the scope of "without melting" and the like as used herein.

Whatever the reduction technique used in step 32, the result is a plurality of initial metallic particles 22, one of which is shown schematically in FIG. 3 as a free-flowing particle, desirably having a size of no greater than about 0.5 inch, more preferably no greater than 025 inch, and more preferably no greater than about 0.070 inch. The size may be as large as about 0.25-0.5, for use in available processing equipment. The particles 22 are preferably generally equiaxed in shape, although they are not necessary perfectly equiaxed. Slightly non-equiaxed particles are preferred, as they tend to compact together more readily than do equiaxed particles. The size, indicated as D in FIG. 3, is the smallest dimension of the particle 22. In other cases, the particles 22 clump together to form agglomerates 24, as shown in FIG. 4. For agglomerated particles, the size D is the smallest dimension of the agglomeration 24.

The size D is preferably no greater than about 0.5 inch, preferably no greater than about 0.25 inch, preferably no greater than about 0.070 inch, more preferably no greater than about 0.040 inch, and most preferably in the size range of from about 0.020 inch to about 0.040 inch. Larger particles and agglomerations may be formed in the reduction process, but the particles and agglomerations are screened to remove the larger particles and agglomerations. The screening does not involve comminution of the particles, only selection of those within the specified size range from the larger mass of particles.

The small but controlled size is a desirable feature of the present invention. In conventional processing of alloys such as alpha-beta and beta titanium alloys, large chemical defects such as large regions of hard alpha phase (alpha phase with interstitial elements therein) and high-density inclusions may be formed. Once formed, the large chemical defects are exceedingly difficult to dissolve and remove in subsequent melting and remelting steps. In the present approach, the possible size of such chemical defects is limited by limiting the size of the particles, inasmuch as the chemical defect size cannot be larger than the size. Additionally, the small size reduces the likelihood of entrapping of volatile components and reactants used in the reduction process or reaction products. The use of small as-produced metallic particles also avoids the need to crush, shear, or otherwise comminute larger particles, sponge, or other physical forms of material. Such comminution operations may cause surface contamination of the particles by the comminution machinery, which contamination may lead to the production of hard-alpha defect or other types of chemical defects. The heat generated by the comminution processing may cause burning of the particles, which in turn may lead to the formation of hard alpha defects. These deleterious effects of comminution are avoided by the present approach The particles 22 may be quite small. However, the size D is preferably not smaller than about 0.001 inch. Smaller particles of titanium, magnesium, and some other alloys may be subject to a rapid oxidation that constitutes a burning of the particle, and which in turn constitutes a fire hazard. This risk is minimized by not using particles or agglomerates of a size D less than about 0.001 inch.

Where the particles are about 0.070 inch or larger, with D as large as about 0.25-0.5 inch, the present approach still yields important benefits in improved quality of the final material. The reduction processing is conducted at relatively low temperatures and short times, reducing the production of chemical defects. The use of master alloys and blending is avoided in many instances, avoiding chemical defects that find their origin in the master alloys and the blended materials. However, as noted above, the use of the particles less than about 0.070 inch in size reduces the incidence of the defects even further.

The plurality of initial metallic particles 22 is melted and solidified to produce the metallic article, step 34. The melting and solidification 34 may be accomplished without any addition of an additional metallic alloying element to the initial metallic particle in its melted state. The melting and solidification 34 may be accomplished in a single step, or there may be two or more melting and solidification steps 34. The melting may be performed by any operable technique, with hearth melting, induction skull melting, and vacuum arc melting being preferred in the case of titanium-base alloys.

The melting and solidification 34, in conjunction with the use of the small initial metallic particles as the feedstock for the melting operation and the absence of comminution of the particles, results in a reduced incidence and size of chemical defects in the solidified metallic article. Any chemical defects found in the initial metallic particles are small, because of the small sizes of the initial metallic particles. During melting, these small chemical defects may be dissolved into the melt, removing such chemical defects so that they are not present in the solidified metallic article.

It is preferred for most applications that there be exactly one melting and associated solidification of the metal in step 34, because a significant source of hard alpha defects in titanium alloys is surface contamination between successive melting steps. However, in other circumstances, where hard alpha defects are not a concern or where the contamination may otherwise be controlled, multiple melting and solidification substeps within step 34 may be used.

There may be intentional metallic and other additions to the melt during the melting and solidification step 34. Such additions may be made using master alloys, blending of alloying additions, or any other operable approach. Where there are no such additions, the composition of the final metallic article is determined by the composition of the metallic particles in the reduction step to 32.

The solidified metallic article of step 34 may be used in its as-solidified state, as a cast metallic article. If, however, the selected metallic material or alloy is a wrought alloy that is suitable for mechanical working, the solidified metallic material may optionally be further worked to alter its microstructure, modify its mechanical properties, and/or change its shape. In one practice, the metal is solidified in step 34 as a cast ingot. The cast ingot is then converted to a billet, step 36, by mechanical or thermomechanical working, such as by hot forging, upsetting, extrusion, rolling, or the like. These conversion steps may be performed in multiple stages, with appropriate intermediate heat treatments.

The billet is thereafter optionally fabricated into a final metallic article, step 38, by any operable technique. Typical fabrication techniques 38 include machining, shaping, forming, coating, and the like. Steps 36 and 38 are used to fabricate a gas turbine engine disk such as that illustrated in FIG. 1.

The metallic article may be ultrasonically inspected at any stage after it is solidified in step 34. For manufacturing articles such as gas turbine engine disks that are sensitive to the presence of mechanical and/or chemical defects, the metallic article is typically ultrasonically inspected multiple times during steps 36 and 38.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for producing a metallic cast article comprising metallic constituent elements comprising the step of melting and solidifying a plurality of initial metallic alloy particles together to form a cast article;

wherein the initial metallic alloy particles were produced by a process which included chemically reducing a non-metallic precursor compound of the metallic constituent elements to produce the initial metallic alloy particles without melting the initial metallic alloy particles.

2. The method of claim 1, wherein the step of melting and solidifying produces a cast article having more titanium by weight than any other element.

3. The method of claim 2, wherein the cast article further comprises at least one alloying element selected from the group consisting of iron, chromium, tungsten, molybdenum, aluminum, niobium, silicon, tin, zirconium, manganese, and vanadium.

4. The method of claim 1, wherein the step of melting and solidifying produces a cast ingot.

5. The method of claim 1, wherein there is no mechanical comminution of the initial metallic alloy particles.

6. The method of claim 1, wherein the step of melting and solidifying includes the step of melting and solidifying the initial metallic alloy particles to produce the cast article, without any addition of a metallic alloying element to the initial metallic particles.

7. The method of claim 1, wherein the step of melting and solidifying includes the step of adding a metallic alloying element to the initial metallic alloy particles while the initial metallic alloy particles are melted.

8. The method of claim 1, wherein the method includes an additional step, after the step of melting and solidifying, of converting the cast article into a billet.

9. The method of claim 1, wherein the process of producing the initial metallic alloy particles included chemically reducing the nonmetallic precursor compound by solid-phase reduction.

10. The method of claim 1, wherein the process of producing the initial metallic alloy particles included chemically reducing the nonmetallic precursor compound by fused salt electrolysis.

11. The method of claim 1, wherein the process of producing the initial metallic alloy particles included chemically reducing the nonmetallic precursor compound by vapor-phase reduction.

12. The method of claim 1, wherein the process of producing the initial metallic alloy particles included chemically reducing the nonmetallic precursor compound by contact with a liquid selected from the group consisting of a liquid alkali metal and a liquid alkaline earth metal.

13. The method of claim 1, wherein the process of producing the initial metallic alloy particles included mixing a nonmetallic modifying element into the nonmetallic precursor compound, wherein the nonmetallic modifying element is selected from the group consisting of oxygen and nitrogen.

14. The method of claim 1, wherein the process of producing the initial metallic alloy particles further included furnishing a mixture of at least two different nonmetallic precursor compounds.

15. The method of claim 1, wherein the process of producing the initial metallic alloy particles further included furnishing the nonmetallic precursor compound comprising titanium.

16. The method of claim 1, wherein the process of producing the initial metallic alloy particles further included furnishing the nonmetallic precursor compounds comprising titanium and at least one other metallic element.

17. A method for producing a metallic cast ingot comprising metallic constituent elements comprising steps:

(a) compacting a plurality of initial metallic alloy particles; and (b) melting and solidifying the plurality of initial metallic alloy particles compacted in (a) to form a cast ingot;

wherein the initial metallic alloy particles were produced by a process which included chemically reducing a nonmetallic precursor compound of the metallic constituent elements to produce the initial metallic alloy particles without melting the initial metallic alloy particles.

18. The method of claim 17, wherein the process of producing the initial metallic alloy particles included producing the initial metallic alloy particles as non-equiaxed particles.

19. The method of claim 17, wherein the process of producing the initial metallic alloy particles included producing the initial metallic alloy particles having a size of from about 0.001 to about 0.070 inch.

20. A method for producing a metallic cast ingot comprising metallic constituent elements comprising the step of melting and solidifying a compacted plurality of initial metallic alloy particles to form a cast ingot;

wherein the compacted initial metallic alloy particles were produced by a process which included chemically reducing a nonmetallic precursor compound of the metallic constituent elements to produce the initial metallic alloy particles without melting the initial metallic alloy particles and which further included compacting a plurality of the initial metallic alloy particles.

* * * * *